US012133620B2

(12) United States Patent
Upadhyay et al.

(10) Patent No.: US 12,133,620 B2
(45) Date of Patent: Nov. 5, 2024

(54) DISHWASHER WITH DIRECT WATER SUPPLY

(71) Applicant: Whirlpool Corporation, Benton Harbor, MI (US)

(72) Inventors: Divyam Upadhyay, Pune (IN); Prabhjee Anand, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 292 days.

(21) Appl. No.: 17/669,837

(22) Filed: Feb. 11, 2022

(65) Prior Publication Data

US 2023/0255439 A1 Aug. 17, 2023

(51) Int. Cl.

| | |
|---|---|
| ***A47L 15/16*** | (2006.01) |
| ***A47L 15/42*** | (2006.01) |
| ***A47L 15/50*** | (2006.01) |

(52) U.S. Cl.

CPC ..... *A47L 15/4221* (2013.01); *A47L 15/16* (2013.01); *A47L 15/4217* (2013.01); *A47L 15/4219* (2013.01); *A47L 15/4225* (2013.01); *A47L 15/4229* (2013.01); *A47L 15/4291* (2013.01); *A47L 15/508* (2013.01)

(58) Field of Classification Search

None

See application file for complete search history.

(56) References Cited

U.S. PATENT DOCUMENTS

| | | | |
|---|---|---|---|
| 9,138,123 B2 | 9/2015 | Classen et al. | |
| 9,138,125 B2 | 9/2015 | Heisele et al. | |
| 2010/0139698 A1 | 6/2010 | Gnadinger et al. | |
| 2011/0114140 A1* | 5/2011 | Heisele | A47L 15/0015 68/12.01 |
| 2018/0110395 A1 | 4/2018 | Thiyagarajan | |
| 2021/0315440 A1* | 10/2021 | Brodowski | A47L 15/4229 |

FOREIGN PATENT DOCUMENTS

| | | | |
|---|---|---|---|
| DE | 102009011571 | A1 | 9/2010 |
| EP | 0914800 | A2 | 5/1999 |
| EP | 1352605 | A1 | 10/2003 |
| EP | 1864603 | B1 | 2/2010 |
| EP | 3141176 | A1 | 3/2017 |
| EP | 3146882 | A1 | 3/2017 |
| EP | 2919637 | B1 | 9/2017 |
| EP | 3731719 | A2 | 11/2020 |
| EP | 3788934 | A1 | 3/2021 |
| EP | 3898595 | A1 | 10/2021 |
| WO | 2019132818 | A2 | 7/2019 |

OTHER PUBLICATIONS

European Patent Office, Extended Search Report re Corresponding Application No. 23156174.7-1016, Jul. 1, 2023, 3 pages, Munich, Germany.

* cited by examiner

*Primary Examiner* — Levon J Shahinian

(74) *Attorney, Agent, or Firm* — McGarry Bair PC

(57) ABSTRACT

A dishwasher and method for treating dishes according to a cycle of operation, wherein the dishwasher can include a tub at least partially defining a treating chamber, a dish rack movably received within the treating chamber and a spray system fluidly connected to the water supply. The dish rack is configured for receiving dishes or utensils for treatment during the cycle of operation. The spray system can include a set of sprayers located within the treating chamber that are configured to selectively emit spray from the water supply onto dishes or utensils on the dish rack.

20 Claims, 4 Drawing Sheets

DISHWASHER WITH DIRECT WATER SUPPLY

BACKGROUND

Contemporary automatic dishwashers for use in a typical household can include a tub and one or more dish holders, such as upper and lower racks or baskets, for supporting soiled dishes and utensils within the tub. A spray system is provided for recirculating wash liquid throughout the tub to remove soils from the dishes loaded into the racks. A water supply circuit, which typically includes a siphon break and water tank, provides water to the spray system from a household water supply. The dishwasher can also include a controller that implements pre-programmed cycles of operation to wash dishes contained in the tub.

BRIEF DESCRIPTION

In one aspect, the present disclosure relates to a dishwasher for treating dishes according to a cycle of operation, the dishwasher comprising a tub at least partially defining a treating chamber, at least a first dishrack and a second dishrack located in the treating chamber, at least a first sprayer and a second sprayer, each of the sprayers emitting a liquid into the treating chamber, a fluid recirculation circuit, including at least a heating element and a recirculation pump, fluidly coupling the treating chamber to the first sprayer and the second sprayer whereby fluid emitted by both the first sprayer and the second sprayer is recirculated through the treating chamber, a water supply circuit having a siphon break fluidly coupled to a household water supply valve and a water tank fluidly coupling the siphon break to the treating chamber; and a water bypass circuit fluidly coupling the household water supply valve directly to the recirculation circuit and an isolating valve fluidly uncoupling the second sprayer from the recirculation circuit, such that water is directly supplied from the household water supply valve to the recirculation pump and to the first sprayer while bypassing the water supply circuit and the second sprayer, wherein water can be supplied directly from the household water supply valve to the fluid recirculation circuit where it can be heated by the heater, recirculated by the recirculation pump through the sprayer, and emitted through the sprayer into at least a portion of the dishrack.

In another aspect, the present disclosure relates to a dishwasher for treating dishes according to a cycle of operation, the dishwasher comprising a tub at least partially defining a treating chamber, at least one dishrack located in the treating chamber, at least one sprayer emitting a liquid into at least a portion of the dishrack, a fluid recirculation circuit, including at least a heating element and a recirculation pump, fluidly coupling the treating chamber to the sprayer whereby fluid emitted by the sprayer is recirculated back through the sprayer, a water supply circuit fluidly coupling a household water supply valve to the treating chamber, and a water bypass circuit fluidly coupling the household water supply valve directly to the fluid recirculation circuit while bypassing the water supply circuit, wherein water can be supplied directly from the household water supply valve to the fluid recirculation circuit where it can be heated by the heater, recirculated by the recirculation pump through the sprayer, and emitted through the sprayer into at least a portion of the dishrack.

DETAILED DESCRIPTION

Figure 1:
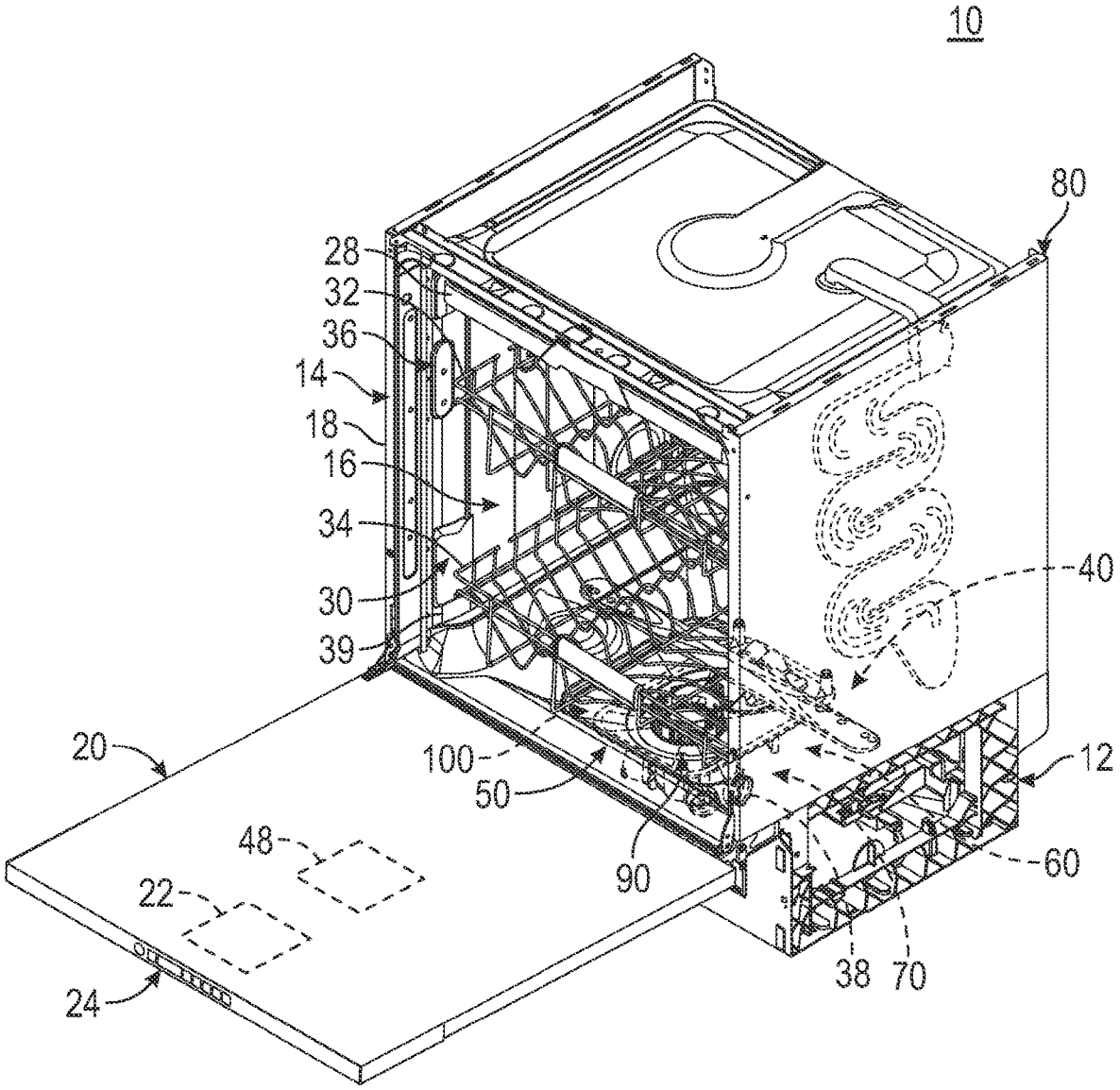
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported a open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can be included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks", which are located within the treating chamber 16. The upper dish racks 32 and the lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slideably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and the third level rack 28 still slide into the treating chamber 16.

Another dedicated dish holder can be a silverware basket (not shown), which is typically carried by one of the upper or lower dish racks 32, 34 or mounted to the door assembly 20. A utensil portion as a silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
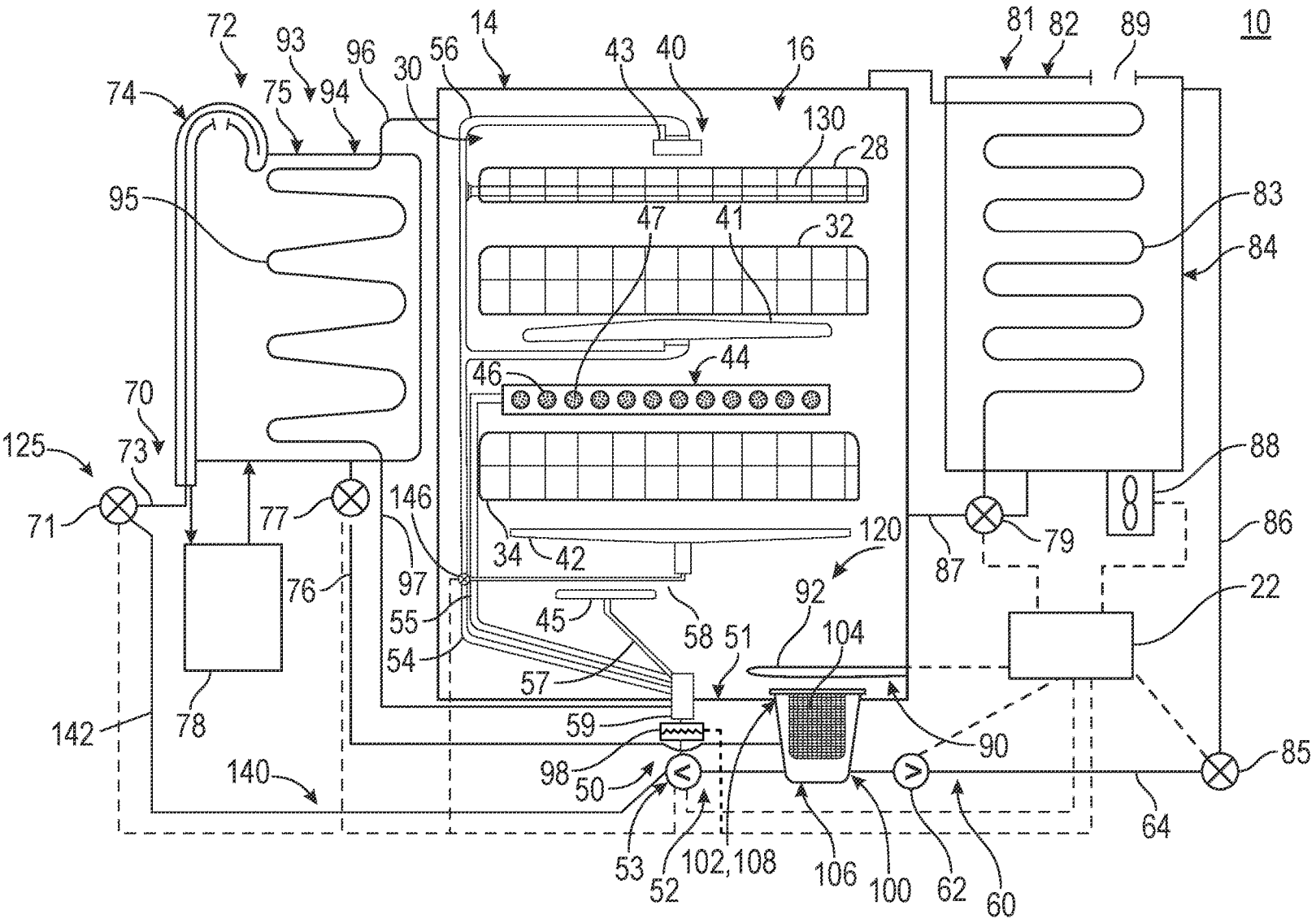
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 is illustrated as being fixed, but could move, such as in rotating. In addition to the third level sprayer 43 or in place of the third level sprayer 43, the sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which, as illustrated, would like along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders with deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and include the pump assembly 52. The recirculation pump 53 can be located within the tub 14.

Multiple supply conduits 54, 55, 56, 57, 58 fluidly couple the sprayers 28-44 to the recirculation pump 53. A recirculation valve 59 can selectively fluidly couple each of the conduits 54-58 to the recirculation pump 53. While each sprayer 28-44 is illustrated as having a corresponding dedicated supply conduit 54-58 one or more subsets, comprising multiple sprayers from the total group of sprayers 28-44, can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The household water valve 71 can have one input and 2 outputs. For example, the household water valve can be a double solenoid valve. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

A fluid recirculation circuit 120 can be considered as a part of the recirculation system 50. In the fluid recirculation circuit 120, the treating chamber 16 is fluidly coupled to the sprayers 41-45. In one nonlimiting example, the fluid recirculation circuit 120 can include the treating chamber 16, sprayers 41-45 with corresponding conduits 54-58, the heater 92, the recirculation pump 53, and the sump 51 fluidly connected to an inlet of the recirculation pump 53. During operation, the fluid can be emitted by the sprayers 41-45 into the treating chamber 16 and collect in the sump 51 where it can be heated by the heater 92 and returned to the sprayers 41-45 by the recirculation pump 53 via conduits 54-58.

Water can be supplied directly from the household water supply valve 71 to the fluid recirculation circuit 120 where it can be heated by the heater 92, recirculated by the recirculation pump 53 through the lower spray arm 42, and emitted through the lower spray arm 42 into at least a portion of the dishrack such as a utensil portion or basket. In one nonlimiting example, the lower spray arm 42 emits spray only on the utensil portion of the dishrack. Thus, utensils or dishes in the utensil portion of the dishrack can receive treatment by a focused, heated spray to facilitate cleaning when the removal of substantial amounts of food, grease, cooking residues, or other contamination is desired.

A water supply circuit 125 can be considered to be included in the water supply system 70, where the water supply circuit 125 includes the household water supply valve 71, the siphon break 74, the supply tank 75, and the treating chamber 16. In the water supply circuit 125 the siphon break 74 can fluidly couple to the household water supply valve 71 while the supply tank 75 fluidly couples the siphon break 74 to the treating chamber 16. The water supply circuit 125 can further optionally include the water softener 78.

A water bypass circuit 140 can fluidly couple the household water supply valve 71 directly to the fluid recirculation circuit 120 by a bypass line 142. The bypass line 142 can fluidly couple the household water supply valve 71 to the inlet of the recirculation pump 53. Additionally, and alternatively, the bypass line 142 can couple the household water supply valve 71 to the sump 51. The water bypass circuit 140 can include an isolating valve 146 in at least one of the conduits 54-58. The isolating valve 146 can be in an opened position or a closed position to direct fluid in the conduit. The position of the isolating valve 146 can be controlled by the user, or by the controller 22 during a cycle of operation. A bypass heater 98 can be included in the water bypass circuit 140 for heating the incoming water from the bypass line 142. The bypass heater 98 can be placed, for example, between the recirculation pump 53 and the recirculation valve 59. The bypass heater 98 can replace the heater 92, if desired, and be the only heater in the system.

The isolating valve 146 can be in conduit 54. During operation, the isolating valve 146 can fluidly couple or uncouple the upper and third level sprayers 41 and 43 from the recirculation circuit 120. When the isolating valve 146 is in an opened position, water can flow through conduits 54, 56, and 58 to the upper level sprayer 41, the third level sprayer 43 and the lower spray arm 42. When the isolating valve 146 is in a closed position, water can only flow to the lower spray arm 42. In other words, the isolating valve controls which downstream conduits are supplied by water. Water can thus be selectively supplied from the household water supply valve 71 to a lower level sprayer, such as the lower spray arm 42, while bypassing the water supply circuit 125 and an upper level sprayer such as sprayers 41 and 43.

Figure 3:
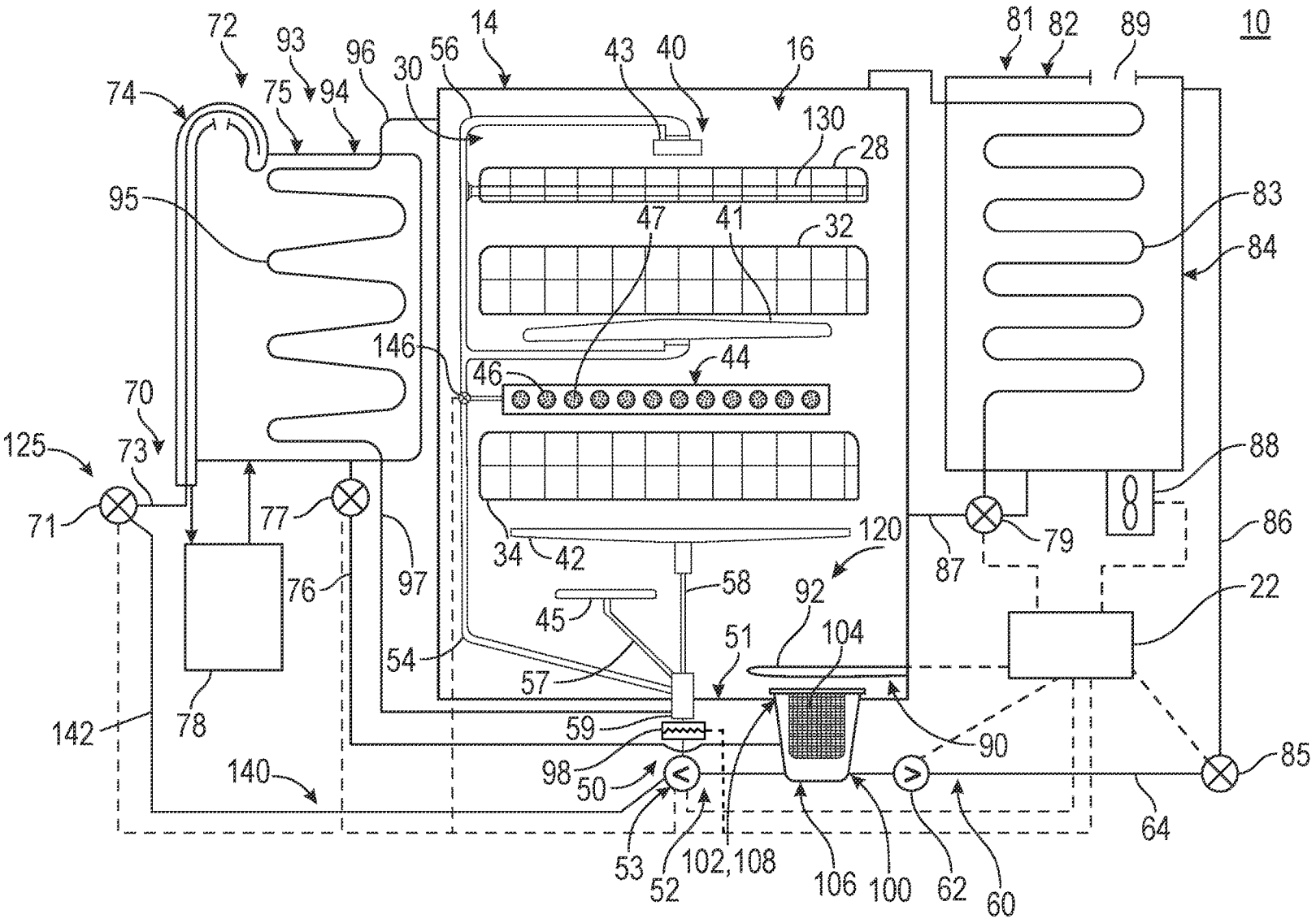
FIG. 3 is a schematic view of the dishwasher of FIG. 1 illustrating an example of the plumbing and electrical connections between at least some of systems.

Additional non-limiting configurations of the conduits 54-58, sprayers 41-45, and isolating valve 146 are contemplated. For example, as shown in FIG. 3, the deep clean sprayer 44 can be connected to conduit 54 along with the upper level sprayer 41, and the third level sprayer 43. In this case, the isolation valve 146 can be located in conduit 54 such that the deep clean sprayer 44 can be isolated from the upper level sprayer 41 and third level sprayer 43. In this case, water can be directed selectively to deep clean sprayer 44 and thus directed to the lower dish rack 34 and the heavily soiled dishes or utensils therein requiring additional cleaning treatment. There are a number of configurations of conduits 54-58 and sprayers 41-45 and plumbing schemes for connecting the water supply valve 71 to the conduits 54-58 and sprayers 41-45 such that specific sprayers downstream of the isolation valve 146 can be isolated from the sprayers upstream of the isolation valve 146. The illustrated plumbing connections are not limiting.

Figure 4:
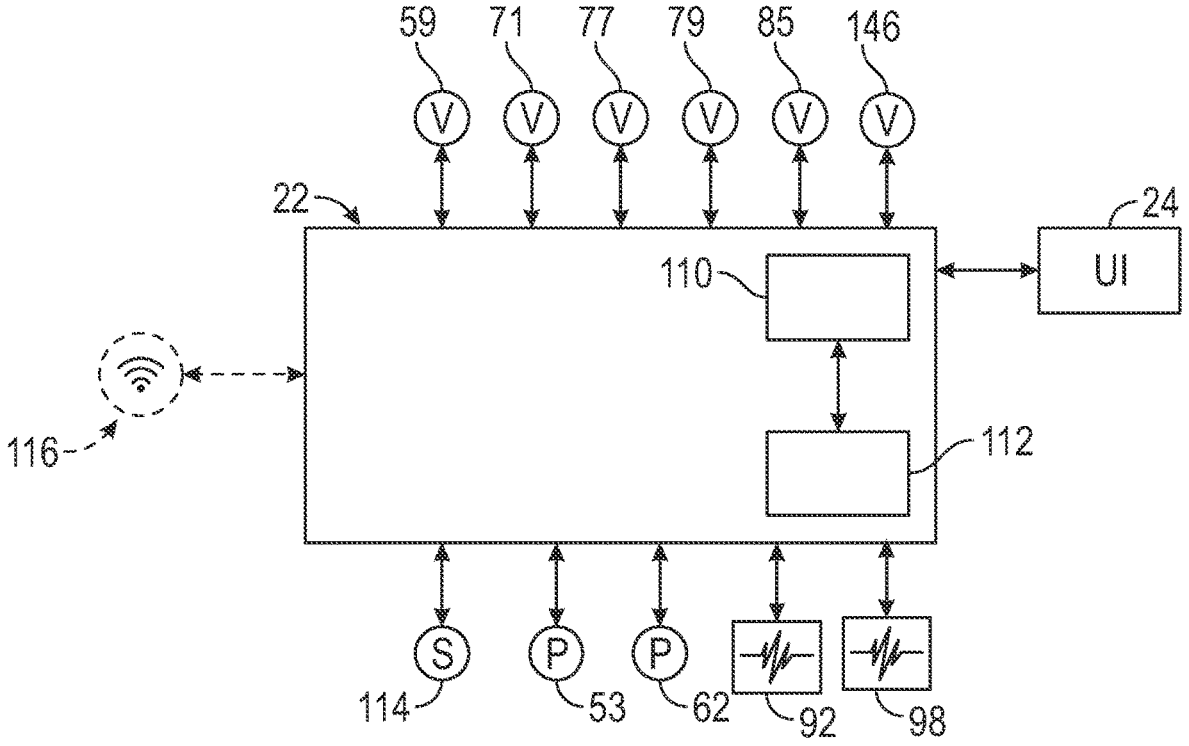
FIG. 4 is a schematic view of a controller of the dishwasher of FIGS. 1 and 2.

As illustrated schematically in FIG. 4, the controller 22 can be coupled with the heater 92 or bypass heater 98 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, the valve 85, and the isolation valve 146. Optionally, the controller 22 can include or communicate with a wireless communication device 116.

In a cycle of operation, a user can select a cycle for washing heavily soiled utensils, for example, a hot wash cycle where the water bypass circuit 140 is utilized. Bypass heater 98 heats the water that enters the appliance through bypass line 142 and is used in the hot wash cycle. In this cycle, the utensils or dishes contaminated with extraordinary amounts of dried foods, grease, or other heavy staining can be placed in a lower dish rack, basket, or other specific region of a dishrack that can be targeted by a specific sprayer such as the lower level sprayer, deep clean or spot sprayer. The hot wash cycle uses water conducted directly from the water supply to the recirculation pump or sump, where it is heated and sprayed onto the contaminated items. In one example, the direct hot wash cycle can be a stand-alone cycle as selected by the user and independent from other cycles of operation. As a stand-alone cycle, the direct hot wash cycle can use a smaller amount of water than a full cycle of operation, providing water and energy savings to the user. Since water is restricted from going to the upper spray arm, water is saved. The supplied water flows through a shorter path bypassing traditional water treatment parts in the hot wash cycle, and is directly supplied to the pump, so energy is saved. The hot wash cycle is shorter than a regular cycle, saving the user time. Additionally, or alternatively, the hot wash cycle can be included as part of a typical cycle of operation in a pre-wash phase or added on as an extra cycle before or after a main wash. The user interface can have buttons that a user can select the hot wash cycle alone, add a single or multiple hot wash cycles to another cycle, or select a cycle that includes the hot wash cycle as a phase. The hot wash cycle can precede or succeed a regular wash cycle.

The hot wash cycle can be used to spray hot water directly into a specific region where heavily soiled items have been placed in order to speed up and improve the cleansing of those items. It is contemplated that the user can specify, at the user interface, the specific sprayers to be used in the hot wash cycle. For example, the hot wash cycle can use an appropriate sprayer to focus hot water on a utensil rack loaded with items that have food caked or dried on from a cooking or baking session. In another example, the hot wash cycle treatment can be directed at a dedicated zone having a used pan or casserole dish that requires deep cleaning. In yet another example, the hot wash cycle can be used for improved cleaning when a dish or utensils have been through a regular cycle and have not been sufficiently cleaned.

After the initial spraying of hot water in the hot wash cycle, the water can be drained. Additionally, and alternatively, the sprayed dishes or utensils can be soaked for a specified time interval after the hot wash cycle and before another cycle is run.

In another example, the hot wash cycle can supply a charge of hot water that is sufficient for recirculation. In this case, the recirculation of the hot water can continue until it is desired to terminate recirculation. For example, recirculation can be terminated after a specified period of time or until a soil level sensor detects a constant reading. Multiple hot spray treatment phases can be carried out according to a user selection, where hot water is sprayed for and then drained or recirculated for a time interval. Multiple hot wash cycles can be carried out automatically based on a predefined soil level and sensor readings.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A dishwasher for treating dishes according to a cycle of operation, the dishwasher comprising:

a tub at least partially defining a treating chamber;

at least a first dishrack and a second dishrack located in the treating chamber;

at least a first sprayer and a second sprayer, each of the first sprayer and the second sprayers emitting a liquid into the treating chamber;

a recirculation circuit, including at least a heating element and a recirculation pump, fluidly coupling the treating chamber to the first sprayer and the second sprayer whereby fluid emitted by both the first sprayer and the second sprayer is recirculated through the treating chamber;

a water supply circuit having a siphon break fluidly coupled to a household water supply valve, the household water supply valve having one input coupled to a household water supply and two outputs, and a water tank fluidly coupling the siphon break to the treating chamber; and a water bypass circuit fluidly coupling the household water supply valve directly to the recirculation circuit and an isolating valve fluidly uncoupling the second sprayer from the recirculation circuit, such that water is directly supplied from the household water supply valve to the recirculation pump and to the first sprayer while bypassing the water supply circuit and the second sprayer;

wherein water can be supplied directly from the household water supply valve to the recirculation circuit where it can be heated by the heating element, recirculated by the recirculation pump through at least one of the first sprayer and the second sprayers, and emitted through the at least one of the first sprayer and the second sprayers into at least a portion of the first dishrack or the second dishrack.

2. The dishwasher of claim 1 wherein the water supply circuit further comprises a water softener.

3. The dishwasher of claim 1 wherein the recirculation circuit further comprises a sump fluidly connected to an inlet of the recirculation pump.

4. The dishwasher of claim 3 wherein the recirculation pump is located within the tub.

5. The dishwasher of claim 3 wherein a bypass line is fluidly coupled to one of the sump or the inlet of the recirculation pump.

6. The dishwasher of claim 5 wherein the bypass line is fluidly coupled to the inlet of the recirculation pump.

7. The dishwasher of claim 1 wherein the first dishrack comprises a utensil portion for holding utensils and the first sprayer emits spray on the at least the utensil portion.

8. The dishwasher of claim 7 wherein the first sprayer emits spray only on the utensil portion.

9. A dishwasher for treating dishes according to a cycle of operation, the dishwasher comprising:

a tub at least partially defining a treating chamber;

at least one dishrack located in the treating chamber;

at least one sprayer emitting a liquid into at least a portion of the dishrack;

a fluid recirculation circuit, including at least a heating element and a recirculation pump, fluidly coupling the treating chamber to the sprayer whereby fluid emitted by the sprayer is recirculated back through the sprayer;

a water supply circuit fluidly coupling a household water supply to an inlet of a household water supply valve and fluidly coupling the treating chamber to a first outlet of the household water supply valve; and a water bypass circuit fluidly coupling a second outlet of the household water supply valve directly to the fluid recirculation circuit while bypassing the water supply circuit, and wherein water supplied directly from the household water supply valve to the fluid recirculation circuit can be heated by the heating element, recirculated by the recirculation pump through the sprayer, and emitted through the sprayer into at least a portion of the dishrack.

10. The dishwasher of claim 9 wherein the at least one sprayer comprises a first sprayer and a second sprayer, both fluidly coupled to the fluid recirculation circuit.

11. The dishwasher of claim 10 wherein the water bypass circuit comprises a bypass valve fluidly coupling the second sprayer to the fluid recirculation circuit such that the second sprayer can be fluidly uncoupled to the fluid recirculation circuit when water is supplied through the water bypass circuit.

12. The dishwasher of claim 9 wherein the water supply circuit comprises a water tank storing a charge of water for dispensing into the treating chamber.

13. The dishwasher of claim 12 wherein the water supply circuit further comprises a siphon break fluidly coupling the household water supply valve to the water tank.

14. The dishwasher of claim 13 wherein the water supply circuit further comprises a water softener.

15. The dishwasher of claim 9 wherein the fluid recirculation circuit further comprises a sump fluidly connected to an inlet of the recirculation pump.

16. The dishwasher of claim 15 wherein the recirculation pump is located within the tub.

17. The dishwasher of claim 15 wherein the water bypass circuit is fluidly coupled to one of the sump or the inlet of the recirculation pump.

18. The dishwasher of claim 17 wherein the water bypass circuit is fluidly coupled to the inlet of the recirculation pump.

19. The dishwasher of claim 9 wherein the dishrack comprises a utensil portion for holding utensils and the at least one sprayer emits spray on the at least the utensil portion.

20. The dishwasher of claim 19 wherein the at least one sprayer emits spray only on the utensil portion.

* * * * *